US006022072A

United States Patent [19]

Moyer

[11] Patent Number: 6,022,072

[45] Date of Patent: Feb. 8, 2000

[54] DEBRIS COLLECTOR FOR UPHOLSTERED FURNITURE

[76] Inventor: Lee Beth Moyer, 1280 Shoemakersville Rd., Shoemakersville, Pa. 19555

[21] Appl. No.: 09/053,921

[22] Filed: Apr. 2, 1998

[51] Int. Cl.[7] ..... A47D 15/00

[52] U.S. Cl. ..... 297/182; 297/218.1; 297/218.4; 297/218.5; 297/219.1; 297/226; 297/228.1; 248/909

[58] Field of Search ..... 297/182, 218.1, 297/218.4, 218.5, 219.1, 226, 228.1, 228.12; 248/909; 211/175

[56] References Cited

U.S. PATENT DOCUMENTS

| | | | |
|---|---|---|---|
| 2,571,574 | 10/1951 | Hicks | 297/182 |
| 2,771,127 | 11/1956 | Cole | 297/182 |
| 2,836,229 | 5/1958 | Spetner | 297/182 |
| 2,916,159 | 12/1959 | O'Neill | 248/909 X |
| 4,948,195 | 8/1990 | Saunders | 297/182 |
| 5,547,249 | 8/1996 | Riley et al. | 297/226 X |
| 5,615,850 | 4/1997 | Cloninger | 248/909 X |
| 5,722,723 | 3/1998 | Riley et al. | 297/226 X |

*Primary Examiner*—Milton Nelson, Jr.
*Assistant Examiner*—Rodney B. White
*Attorney, Agent, or Firm*—Charles A. Wilkinson

[57] ABSTRACT

A device for placement into a gap or crevice of a piece of upholstered furniture such that debris and small articles that fall below the seating cushions of such furniture are retained on the device as opposed to passing through the gap or crevice area and into the interior of the piece of furniture. Frictional protuberances on the device maintain the device firmly in the gap or crevice area such that the device's seal integrity in the gap or crevice area is not interrupted by normal movement by a person on the piece of furniture.

20 Claims, 3 Drawing Sheets

DEBRIS COLLECTOR FOR UPHOLSTERED FURNITURE

BACKGROUND OF THE INVENTION

1. Field of the Invention

The present invention relates generally to a debris collection and prevention device, and more particularly to a device which is effectively retained underneath the seating cushions of an upholstered piece of furniture to prevent debris and other small objects from becoming temporarily or even irretrievably lost within the upholstered body of such piece of furniture.

2. Preliminary Discussion

Upholstered furniture has its advantages as well as its disadvantages. From an aesthetic viewpoint, upholstery can make an old piece of furniture look and feel brand new. If the padding is wearing thin, all one has to do is remove the upholstery, update the padding, and reapply the upholstery, resulting in a brand new experience. If the upholstery has faded, or the owner wants to change the furniture's existing design or color without going through the expense of obtaining a brand new piece, the owner merely has to have the piece of furniture reupholstered and the problem is economically and efficiently solved.

The method of applying upholstery to a piece of furniture, however, is deficient in one major respect, namely the presence of crevices between adjoining parts or portions of such furniture. An upholstered piece of furniture is, in essence, a basic structure (framework and padding) that is wrapped with a piece of fabric. Underneath the seating cushions, there is an upholstery intersection located along the rear where the back section of the piece of furniture abuts or meets the lower or floor section. The present inventor has found that with new pieces of furniture, this abutment can vary from being relatively tight, providing little or no avenue through which small objects may pass, particularly if the design places the rear cushions over the edge of the lower or floor section, to relatively loose. With older pieces of furniture, and through years of use, this abutment, if initially tight, may tend to loosen, or the cushioning shrinks from wear, resulting in a sizable entrance gap or crevice into the inner regions or lower portion of the piece of furniture. A similar relationship may be found adjacent the arms of upholstered chairs and couches.

It is not uncommon for loose change and the like to fall from a person's pocket when such person sits down on a couch or chair. It is also not uncommon for people, in general, to lose various things at random under the cushions of a couch or upholstered chair, especially if the couch is a popular resting and/or working area. Small or slender objects, such as coins, writing utensils, remote controls, valuables or the like, often become lost inside pieces of furniture, because such objects "fall through the cracks", or seams, or crevices in the upholstery, often to be found years later when the furniture is lifted or moved. These loose or open upholstery crevices can become very expensive, especially if a family heirloom or a valuable pieces of jewelry falls through the seams and becomes "lost."

If the bottom of the lower portion of the piece of furniture is open, anything which falls through the crevice will fall through to the floor and may be temporarily lost until the piece of furniture is moved. However, most upholstered furniture pieces, including many combination pieces such as sofa-beds and the like, almost invariably have the bottom closed with a cloth to "finish" the piece and prevent dirt and dust derived from the floor from collecting in the lower portion of the piece of furniture. In such pieces, anything which falls through the rear crevice into the interior of the piece will, for all practicable purposes, be irretrievably lost. Also, dirt and debris that passes through the rear crevice ends up in the interior of the piece causing an unsanitary condition.

While it would be possible to connect the adjoining sections, such as the back and the seat, of upholstered furniture with cloth strips or the like to essentially close off the normal crevices between them, thus eliminating any opening through which objects may fall, and occasionally such cloth strips are found on certain furniture pieces, this expedient has been found not really to be practical. Any such cloth strips need to have a fair amount of slack or they will tend to tear due to stress placed upon them from the movements and weight of occupants of such upholstered furniture, and if such strips are provided with sufficient slack to alleviate any tension upon them, they will in themselves create a significant pocket into which small objects and particularly dirt and trash may collect. In such cases, it may be more sanitary to allow any dirt and debris to fall completely through the crevice, particularly in these days when few persons have personal maids or cleaning personnel to clean each crevice. In addition, the addition of significant extra material to alleviate a problem which most purchasers of upholstered furniture imagine they will encounter only on a sporadic basis, even though it, in fact, happens extremely frequently, however frustrating such problem is when it occurs, and which most purchasers of furniture do not even think of or consider at the time of purchase, is not normally considered to be adequate reason to incur the additional costs of designing the original furniture around the problem or even making modifications to alleviate the problem.

Thus, while there have been previous crevice guards in which strips of plastic, cloth or the like have been designed to fit in or across the gap or crevice between upholstered portions of seating devices, including furniture and automotive seats and the like, these prior devices are not known to have attained any substantial use or market success.

There has been and presently is a need, therefore, for a device which will create a barrier between the accessible sections of an upholstered piece of furniture, located underneath the seating cushions, and the inner regions of the piece of furniture, accessible normally only through the rear crevice in the upholstery, so that small objects and the like will be prevented from becoming lost inside the piece of furniture. Such barrier-type device should fit securely into the crevice, so that any movement by a person using the piece of furniture, whether such movement is derived from normal everyday usage or from the shifting or removal of the seating cushions, will not destroy the barrier's integrity. The device should be easy to insert into, and remove from, the piece of furniture, and should be easy to clean while in its secured position in the piece of furniture.

3. Description of Related Art

The present inventor has conceived of a device which addresses all of the aforementioned concerns, as well as many concerns not shown or addressed by the prior art. The unitary device of the present invention comprises several sections including a handle section, integrated into its single-piece construction, which makes insertion into and removal from upholstered furniture relatively effortless. A collection or blocking section incorporates the collection surface of the device of the invention, or the section which is exposed to the seating cushions and onto which small objects would fall. This section or surface is easily clean-able. All edges of the device of the invention are smooth, or rounded, so that the implementation or use of the device of the invention will not tear or damage either the upholstery or the seating cushions which contact the device. Finally, a unique self-securing or self-wedging section maintains the device of the invention in a fastened position, so that normal movement on or removal of the seating cushions will not cause the integrity of the device within the furniture to either weaken or fail altogether.

Devices of this general nature, i.e. relating to debris collection, accumulation or prevention for upholstered furniture, have not seen many innovations or improvements during the last 40 years. U.S. Pat. No. 2,571,574 issued on Oct. 16, 1951 to E. J. Hicks, entitled "Gap Cover Attachment for Automobile Seats", discloses an elastic-band material which extends over and covers the space between two adjoining automobile seat cushions. The Hicks device was designed to prevent "debris, such as dirt, matches, and similar objects from falling between the seats." It is fixedly attached, both behind the back of the seat and below the front of the seat, and its length is adjustable by means of a buckle fastener. The device of the present invention, on the other hand, is designed to releasably extend along the back crevice of an upholstered seat, thereby preventing debris and small objects from falling into such crevice or other crevice and into the seat. The device of the present invention is more comprehensive in its protection than the one-dimensional "gap covers" akin to Hicks, due particularly to the difference in environments in which the two devices are used.

U.S. Pat. No. 2,771,127 issued on Nov. 20, 1956 to C. C. Cole, entitled "Receptacle for Upholstered Furniture", discloses a through-shaped, "V"-shaped device which is removably positioned in the crevices between adjacent walls of the piece of furniture. The Cole device is designed to trap foreign objects within the device that would otherwise fall through the crevice in the upholstery and end up within the body of the furniture, and is removable by way of handles located along the edges of the receptacle. The device of the present invention is not a hollow receptacle, and therefore, is not designed to "trap" anything. The device of the present invention also contains an additional securing feature, not present within the Cole device, which maintains the crevice seal. The device of the present invention is more efficient in its overall design, since the present invention must merely be wiped clean unlike Cole's device which must be removed and emptied every time it becomes full. Cole's device is also not as revealing or as easy to use as the device of the present invention, as it must be removed in order to expose what has collected within. In addition, since the handle members of the Cole device are not part of its inherent structure, there is the possibility that such handle members may become detached leaving the device irretrievably located within the piece of furniture.

U.S. Pat. No. 2,836,229 issued on May 27, 1958 to N. Spetner, entitled "Sanitary Attachment for Settee", discloses a "T" shaped device comprising a fairly flat top with a sharply-extending bottom capable of being wedged into the narrow gap between the sitting portion and back portion of a restaurant-type booth so as to close that gap and prevent debris from passing into that gap. The Spetner reference has a very limited scope, pertaining only to gap situations akin to restaurant-type booths, and the device of the Spetner reference contains an affixation means for permanent fastening to the exterior of such restaurant-type booth. The device of the present invention comprises a different cross-sectional configuration since it is designed to accommodate a different placement environment. The placement of the device of the present invention is located underneath the seating area so that it is unexposed to the human body and therefore any accumulation of debris remains unexposed to the human body, unlike the Spetner reference. The device of the present invention is also designed to be easily removable, or releasable, also unlike the Spetner reference.

The unique characteristics and operative features of the device of the present invention, are therefore, unrepresented within the prior art. The prior art contains references which address the need for "gap fillers." However, the prior art is outdated in general and unresponsive with respect to any ability to address the concerns of the present inventor. The innovations of the last few years in the furniture industry, and in particular the upholstery business, should be met with the same type of innovations in the field of remediation, to address the concerns and difficulties inherent in the latest methods of upholstering. The device of the present invention is designed to address such concerns in a unique and efficient manner, using techniques and principles not currently shown or disclosed in the prior art.

OBJECTS OF THE INVENTION

It is an object of the present invention, therefore, to provide a device which will prevent debris and other small articles from becoming lost within the body of a piece of upholstered furniture.

It is a further object of the present invention to provide a device which is easy to insert into, and easy to release from, the gap or crevice located underneath the seating cushions and defined between the lower back portion and the seating portion of an upholstered piece of furniture.

It is a still further object of the present invention to provide a device which completely covers a crevice or gap such that debris and small articles may not pass through the crevice or gap and become lost within the body of the piece of upholstered furniture.

It is a still further object of the present invention to provide a device which is easily and efficiently capable of being cleaned while the device is positioned within the crevice or gap section of a piece of upholstered furniture.

It is a still further object of the present invention to provide a device comprised of a single piece construction that is easy to manufacture, manipulate and operate.

It is a still further object of the present invention to provide a device which is designed to accommodate gaps of different lengths.

It is a still further object of the present invention to provide a device which, when inserted into a gap of a upholstered piece of furniture, will not be affected by movement resulting from normal usage or cleaning of the piece of furniture.

Still other objects and advantages of the invention will become clear upon review of the following detailed description in conjunction with the appended drawings.

SUMMARY OF THE INVENTION

The device of the present invention is a single-piece construction designed for insertion into a crevice or gap, such as the crevice or gap located underneath the seating cushions of a piece of upholstered furniture and defined generally by the separation between the back section and seating section of the piece of upholstered furniture. Such "gap" provides an avenue through which debris and small articles may pass into the interior, unaccessible area of a piece of upholstered furniture. The device of the present invention is designed to close this crevice or "gap" in an efficient manner so that debris and small articles are not allowed to pass through, and into the interior section of a piece of upholstered furniture, potentially resulting in the loss of small valuable articles.

The unitary device of the present invention consists of three principal parts or sections including (a) a handle member for operative grasping by a human hand for insertion into and removal from a gap in the article of furniture resulting from the rear upholstery crevice, (b) a wedge-like section which is inserted into the interior of the article of furniture through such gap, and (c) a supportive member which prevents the device of the invention from falling through the gap. When the device of the invention is inserted into the gap, its upper surface retains the debris and other small objects which would otherwise pass through the gap and become lost within the article of furniture. Consequently, it becomes extremely easy to retrieve such debris and small articles that have fallen behind the cushions or pillows. The device of the present invention also preferably incorporates frictional protuberances located along the wedge-like section which self-secure or self-wedge the apparatus of the invention within the framework of the piece of furniture and thereby prevent the device of the invention from sliding around or out from within the piece of furniture.

These additional frictional protuberances are relatively important to the effective operation of the device of the invention. Normal everyday movement of occupants of the furniture could potentially result in a shift in the placement of the device of the invention. Movement of the device of the invention could therefore result in the breakdown of the integrity of the gap "seal", further resulting in the ability for debris and small objects to pass through the gap and into the piece of furniture. The frictional protuberances sturdily maintain the device of the present invention within the gap, and therefore, any movement upon the supporting cushions, or the removal of the supporting cushions for cleaning, will not cause a break in the gap seal's integrity.

DESCRIPTION OF THE PREFERRED EMBODIMENTS

Figure 1:
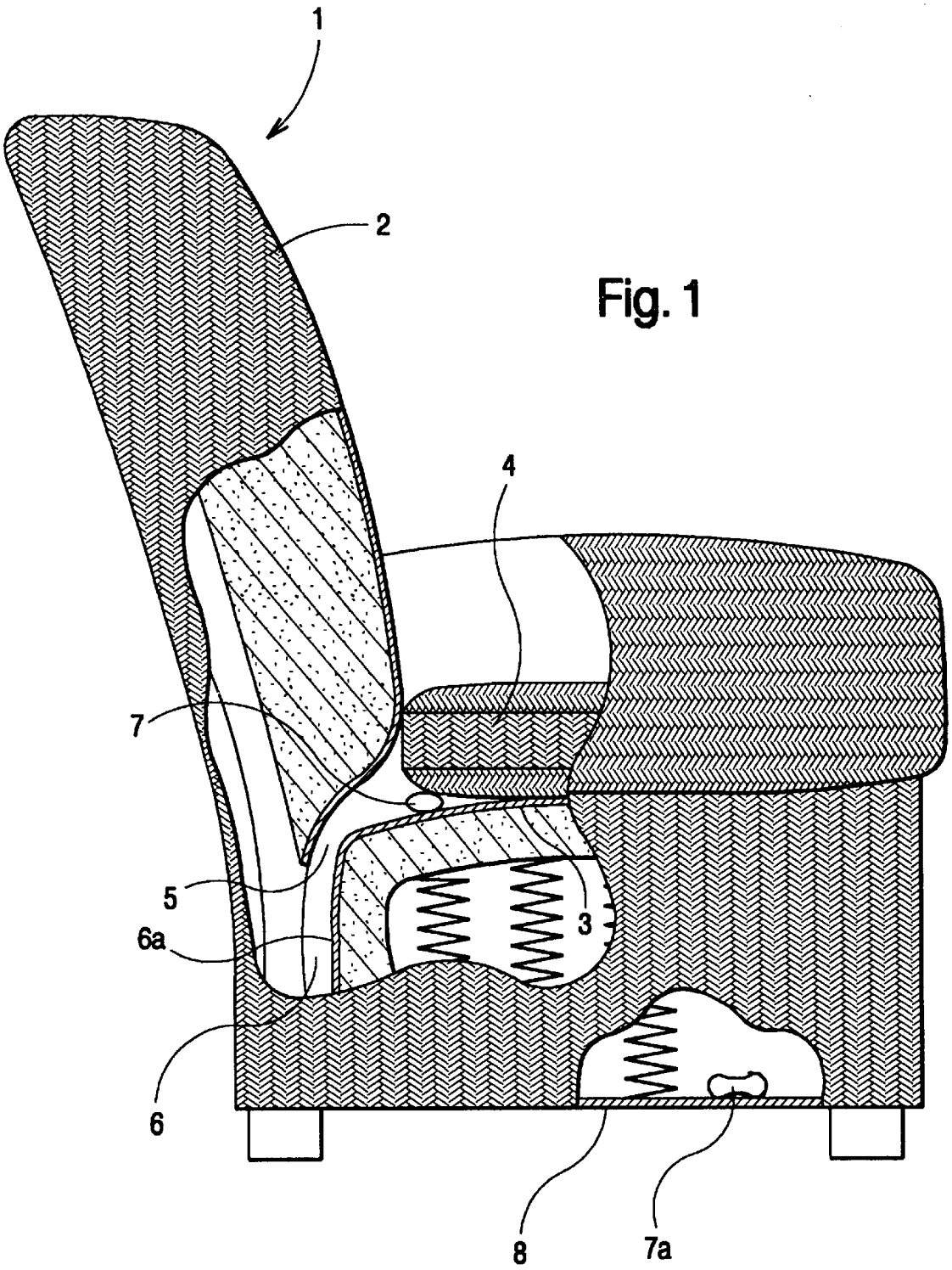
FIG. 1 is a diagrammatic side elevation of a typical upholstered piece of furniture, with a broken-away view of the inside of the piece of furniture showing the separation between the back upholstered section and the seating upholstered section located below the seating cushions in which the device of the invention may be effectively used.

A piece of upholstered furniture has many definitive regions which remain essentially constant from one piece of furniture to the next. The upholstery which envelopes the framework of the piece of furniture leave certain folds, crevices or gaps, which may result in problems for the ordinary user. In order to more fully describe the operation of the device of the invention, FIG. 1, a diagrammatic side view of a piece of upholstered furniture, illustrates the following defining regions and characteristics of a piece of upholstered furniture 1:

- the "back region" 2 is the surface upon which a person rests their back and, if sufficiently elevated, their head. This "back region" 2 may either directly support a person's back, or it may be behind additional pillows or cushions (not shown), in which the "back region" 2 will not be in direct contact with a person's back (not shown) but will be in direct contact with the backrest pillows or cushions.
- the "seating region" 3 is the surface below the seating pillows or cushions 4 which is usually not in direct contact with a seated person (not shown). The "seating region" 3 is usually where debris and small articles 7 gather as such debris or small articles 7 fall below the seating cushions 4.
- the "gap region" 5 is the space defined at the junction between the "back region" 2 and the "seating region" 3, where such space provides passage between the accessible areas of the article of furniture 1, i.e. underneath the seating cushions 4 and the like, and the inaccessible areas 6 of the article of furniture 1, i.e., actually within the article of furniture 1 behind the upholstery and at the bottom above the cloth cover 8 found in most modern furniture pieces to seal the bottom against dirt, lint and other debris from the floor.

These regions are fairly consistent within every piece of upholstered furniture. If the article of furniture 1 does not use additional comforting or support pillows or cushions, then the back 2 and seating 3 regions, as well as the gap region 5, will be exposed to a user during normal everyday use. If the article of furniture 1 does use additional comforting pillows or cushions 4, then all of the defining regions 2, 3 and 5 will be hidden behind these comforting or support pillows or cushions 4.

Figures 2, 2A, 3:
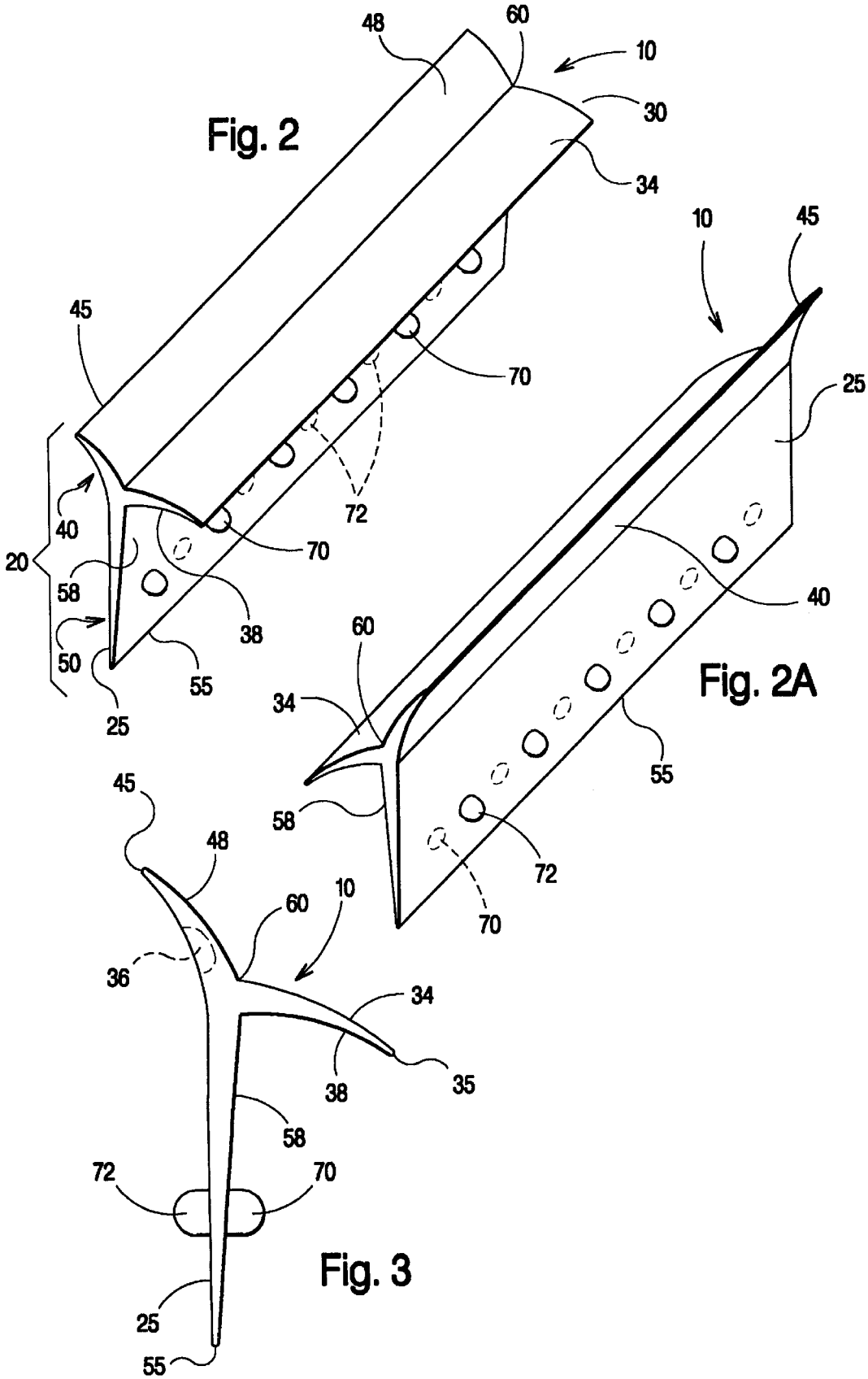
FIG. 2 is an isometric view of the device of the present invention.
FIG. 2A is an isometric view of the device of the invention similar to that shown in FIG. 2 but from the opposite side.
FIG. 3 is an end view of the device of the present invention.

Articles of upholstered furniture 1 which use comforting pillows or cushions 4 are improved the most by implementation of the device of the present invention, shown and described more fully starting with FIG. 2. Debris and small articles 7 which fall between and underneath the comforting cushions or pillows 4 are usually not immediately detected or noticeable. Consequently, it is not until later when the lost articles 7 are actually realized to be missing that the removal of the cushions or pillows 4 and the search within the piece of furniture 1 actually beings. Sometimes, retrieval of "lost" articles 7 which fall onto the "seating area" 3 underneath the cushions or pillows 4 may be done rather easily and efficiently by merely removing the cushions or pillows 4. However, sometimes these "lost" articles 7 find their way through the "gap region" 5 and into the interior framework 6 of the article of furniture 1, thus becoming irretrievable by merely removing the cushions or pillows 4. If the bottom of the furniture piece is open, which is rarely the case with modern furniture, such articles 7 may merely fall to the floor where they may be recovered by merely moving the furniture. However, if, as is frequently and usually the case, the bottom of the furniture is closed by cloth cover 8 to keep dust from accumulating within the framework or inside, the article 7*a* will merely be caught upon such cloth bottom cover 8 and essentially "disappear." See FIG. 1.

The device of the present invention is designed to be inserted into the "gap region" 5 such that the space defined by the "gap region" 5 is closed off, and debris and small articles 7 no longer have the ability to pass through the "gap region" 5 and into the article of furniture 1.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

FIG. 2 is an isometric view of the device of the present invention 10, comprising a wedge-like longitudinal member 20 with an outwardly or forwardly extending supportive member 30. FIG. 2, which only illustrates a relatively short section of member 20, illustrates the characteristic elongated quality or structure of the device of the invention 10 adapting it for extension along the entire gap region 5 of an article of upholstered furniture such as shown in FIG. 1. The oppositely and somewhat upwardly extending section 40 of the longitudinal member 20 opposite the outwardly extending supporting member 30 defines a so-called handle and deflecting member 40, while the section of the longitudinal member 20 extending as shown in FIG. 2 below the intersection of the outwardly extending supportive member 30 and somewhat upwardly extending member 40 defines a wedge-like insertion member 50. As shown in FIG. 2 and more specifically in FIG. 3, the handle and deflection member 40 is preferably curved as to create a snug fit against the back region 2 of a chair or the like as well as the seating region 3 of the piece of furniture. The curvature of the handle and deflection member 40 allows the handle and deflection member to flex in response to being inserted into the gap region 5 of an upholstered chair or lounge, and this is shown and described more specifically in FIG. 4. The rear surface 25 (see FIG. 2A) of the longitudinal member 20 extends from the top edge 45 of the handle member 40 to the bottom edge 55 of the wedge-like insertion member 50 in essentially an uninterrupted fashion, except, in an alternative embodiment, for finger grasping orifices 36 (shown in FIG. 3 in broken outline) or the like, and remains in flexed contact with the "back region" 2 of the piece of upholstered furniture 1 when the device of the present invention 10 is inserted into such piece of furniture 1. These finger grasping orifices 36 (shown in broken outline in FIG. 3) are not a necessity for the proficient operation of the device, but merely assist the user in grasping the handle member 40 during insertion, removal or for easier transport. The front surface of the longitudinal member 20 is defined or separated into two regions separated by the outwardly extending supportive member 30. The section of the front surface of the longitudinal member 20 above the supportive member 30, namely the front surface 48 of the handle and deflection member 40, remains in contact with the rear edge of the seating cushions 4, while the section of the front surface of the longitudinal member 20 below the supporting member 30, namely the front surface 58 of the wedge-like insertion member 50, remains in contact with the interior 6*a* of the piece of upholstered furniture 1, shown in initial FIG. 1. The outwardly extending supportive member 30, in a similar fashion, is defined by an upper surface 34 upon which the rear edges or corners of the seating cushions 4 rest, and a lower surface 38 which contacts the "seating region" 3 of the piece of the upholstered furniture 1, as defined above, and prevents the device of the invention 10 from being completely inserted into and lost within the piece of upholstered furniture 1. The junction between the outer surface 48 of the handle and deflection member 40 and the upper surface 34 of the supportive member 30 defines a corner 60 or a principal collection surface upon which debris and small articles 7 collect, as more particularly shown in FIG. 4, as opposed to passing through the "gap region" 5 and into inaccessible region 6 of the article of furniture 1. Frictional protuberances 70 located along the front surface 58 of the wedge-like insertion member 50 as well as frictional protuberances 72 (shown in phantom in FIG. 2 and more particularly in FIGS. 2A and 3) located along the rear surface 25 of the wedge-like insertion member 50 maintain the device of the invention 10 within the "gap region" 5, and prevent the device of the invention 10 from moving as the cushions or pillows 4 are moved. Such frictional protuberances 70 and 72 are not sharp, but rounded, so they do not tear the upholstery or impede placement of the device, but still tend to self-wedge or secure the device in the crevice to prevent easy withdrawal. These frictional protuberances 70 and 72 are preferably placed on both the front surface 58 and rear surface 25 in an alternating, staggered pattern, although, if the situation necessitates, only the protuberances 70 on the front surface 58 may be used, or alternatively, only the protuberances 72 on the rear surface 25 may be used. Of course if the situation should also necessitate, the protuberances 70 and 72, while preferably staggered or alternating as shown, may be aligned or grouped in repeating patterns (not shown).

FIG. 2A is an isometric rear view of the device of the present invention 10 showing the frictional protuberances 72 on the rear surface 25 of the wedge-like insertion member 50, as well as the frictional protuberances on the front surface 58 shown in phantom to illustrate the arrangement of the two sets of protuberances 70 and 72 in relation to each other. FIG. 2A illustrates the rear protuberances 72 in horizontal alignment with the front protuberances 70. It will be understood that the protuberances 72 may be lower or higher along the wedge-like insertion members, i.e. toward the upper edge 45 or the lower edge 55, than the protuberances 70, and vice versa. The placement of the protuberances as shown in FIGS. 2 and 2A is, however, preferable.

FIG. 3 is an end view of the device of the present invention, showing the collecting surfaces 48, 60 and 34 upon which debris and other small articles 7 (shown in FIG. 1) accumulate, as well as the supporting surfaces 25, 38 and 58 which maintain contact between the device of the invention 10 and the back, seating and gap areas 2, 3 and 5 (shown in FIG. 1). The protuberances 70 and 72 enhance the frictional contact between the device of the present invention 10 and the inner upholstered surface of the seating area 6*a* (shown in FIG. 1). The finger holds or indentations 36 shown in broken lines in FIG. 3 serve where present to make the handle member 40 more graspable for inserting or removing the guard of the invention. Since the device is, one installed, not usually removed or removed only infrequently, the finger holds 36 are optional.

Where the device of the invention is used within upholstered furniture which receives only light use, such as in the reception area of an office or the like, the use of the frictional protuberances 70 and 72 may not be as necessary and they can be dispensed with. This may be advantageous with very delicate or elegant upholstery. However, as indicated, if the protuberances are evenly rounded or curved, they will not be found to be adversely wear inducing. In addition, while the arcuately curved protuberances are highly preferred, other friction inducing means can be used on one or both surfaces of the insertion member 50. For example, the surfaces may be more or less covered with small projections of various sizes and/or shapes of projection. However, the present applicant has found the protuberances as shown and described herein to be most generally the best considering the requirement for maintaining the device of the invention in place and releasing it when desired.

The single-piece construction defining the device of the present invention 10 is preferably constructed from flexible, polymeric materials, to allow the outwardly extending supporting member 30 and the handle member 40 or the longitudinal member 20 to flex in response to the irregularly-shaped gap region 5. The device of the present invention must be responsive to spatial inconsistencies in gap regions 5, since the places defining the back region 2 and seating region 3 may not always be substantially perpendicular. The gap region 5 of initial FIG. 1 illustrates this principle since the gap region 5 is found between the back region 2 which is approximately 30° from the seating region 3, as opposed to a perpendicular 90° from the seating region 3. If both the longitudinal member 20 and the supportive member 30 of the device of the present invention 10 were rigid, the device of the present invention 10 would not be able to securely and frictionally wedge into the interior area 6 of the device of the invention 10. In other words, a flexible construction of the entire device maintains the frictional attachment between the protuberances 70 and 72 and the interior wall 6*a* of the seating region 3.

Both the outwardly extending supporting member 30 and the handle and deflection member 40 should be preferably flexible in response to varying characteristic seating regions 3, some of which may be slightly more rounded than others. If the supporting member 30 were perfectly straight and rigid, the supporting member 30 would potentially dig into the seating region 3 and damage the upholstery, as well as being possibly uncomfortable to anyone seated on the piece of furniture. The supporting member 30 is curved slightly downwardly for two reasons, (a) to accommodate a seating region 3 which assumes a convex, rather than a flat or concave, profile and (b) to provide an additional characteristic barrier for debris and other small articles 7. The slight curve downward of the supportive member 30 would tend to flatten out when a force is placed normal to the upper surface 34 of the supportive member 30. If there was no slight curve downward, then a normal force imparted to the upper surface 34 of the supportive member 30 might tend to bend the supportive member 30 upward thereby breaking the contact between both the lower surface 38 and the edge 35 of the supportive member with the seating area 3. If the supportive member 30 were allowed to bend upwardly, then debris and other small articles 7 would be able to pass underneath the lower surface 38 and through the gap region 5. Similarly, if the handle and deflection member 40 were perfectly straight and rigid, such handle and deflection member 40 would potentially dig into the back region 2 and damage the upholstery. The handle and deflection member 40 is curved slightly outwardly for two reasons, (a) to accommodate a back region 2 which also assumes a convex, rather than a flat or concave, profile and (b) to provide an additional characteristic barrier for debris and other small articles 7. The slight curve outward of the handle and deflection member 40 would tend to flatten out when a force is placed normal to the outer surface 48 of the handle and deflection member 40. If there was no slight curve outward, then a normal force imparted to the upper surface 34 of the supportive member 34 might tend to cause the entire device of the invention to rotate in the direction of the normal force thereby breaking the contact between the handle and deflection member 40 and the edge 45 of such member with the back area 2. The outward curvature of the handle and deflection member 40 ensures that contact between the edge 45 and the back region 2 will continue irrespective of the nature of the load or force upon the device 10 or the piece of furniture 1. If the handle and deflection member 40 were not outwardly curved, and were not allowed to flex in response to being inserted into the gap region 5, then debris and other small articles 7 would be able to pass between the edge 45 and the back region 2 and behind the rear surface 25 and through the gap region 5.

Each of the edges of the device of the present invention 10, namely the upper edge 45 of the handle and deflection member 40, the lower edge 55 of the wedge-like insertion member 50, and the outer edge 35 of the supportive member 30, are preferably smoothed, or rounded, so that they will not damage upholstery or any surface they contact. The device of the present invention is designed to compressively self-"wedge" into the gap region 5 of an article of furniture 1. This compressive contact is amplified by normal usage and everyday movement of users' bodies upon the seating cushions 4 of the article of furniture 1. Normal usage results in normal, compressive forces of the seating cushions 4 upon the device of the invention 10, as well as transverse, shifting-movement related forces which tend to slide the seating cushions 4 along the upper surfaces 48 and 34 of the device of the invention 10. This everyday movement of the seating cushions 4 upon the device of the present invention creates a number of "wear points" where there is direct contact between the seating cushions 4, the device of the invention 10 and the back region 2 and seating region 3. Therefore, the edges of the device of the invention 10 must be composed of a rounded material, as well as being at least minimally flexible, so that movement of the edges 35, 45 and 55 in response to normal everyday movement of the seating cushions 4 will not cause the device of the invention to wear away at the outer layer of upholstery. Consequently, while the edges of the device may appear fairly sharp in the appended figures, it will be understood that they will actually be rounded or radiused.

Figure 4:
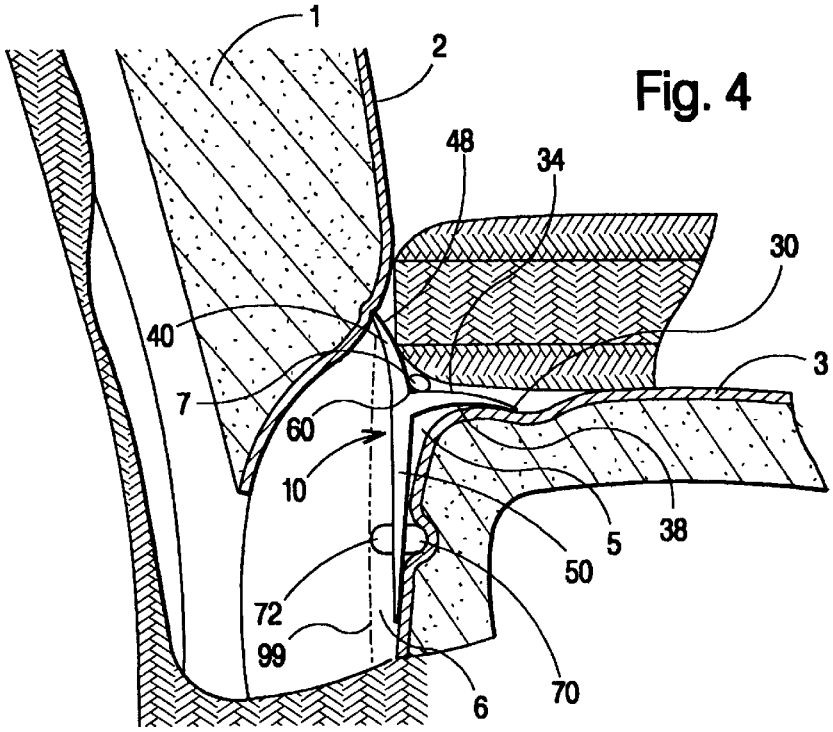
FIG. 4 is a side, diagrammatic view of the broken-away region of FIG. 1 illustrating the placement of the device of the present invention within the separation or gap between the upholstered sections.

FIG. 4 illustrates the operation of the device of the present invention within the gap region 5 of an upholstered piece of furniture 1. After lifting or removal of the cushions, a person would grasp the handle and deflection member 40, push down on the seating region 3 and insert the wedge-like insertion member 50 of the device of the invention 10 through the gap region 5 until the lower surface 38 of the supportive member 30 comes to rest upon the seating region 3. The supportive member 30 supports the device of the invention 10 and prevents the device of the invention 10 from falling through the gap region 5 and into the interior, unaccessible region 6. FIG. 4 illustrates a relatively open interior region 6. The dotted line extension 99 of the back region 2 illustrates a relatively cramped interior region 6 which is also, as shown, able to accommodate the wedge-like insertion member 50 of the device of the present invention with the attached frictional protuberances 70 and 72. With the device of the present invention 10 placed in the gap region 5, the rear section of the seating cushions 4 may contact the surfaces 48 and 34 as shown, and any debris or small articles 7 which would previously pass through the gap region 5 would now collect on the surfaces 48, 60 and 34 of the device of the invention. If a person suspects that an object has been lost underneath the seating cushions 4, such person merely has to lift or remove the cushions 4 to reveal what has collected on the seating region 3 as well as the what has collected on the surfaces 48, 60 and 34 of the device of the invention 10. If a person desires to clean the seating region 3 and the surfaces 48, 60 and 34 of the device of the invention, such person merely has to wipe clean the surfaces 48, 60 and 34 of the device of the invention 10 and remove any debris or small objects that have collected on the seating region 3. In order to remove the device of the invention 10 from the gap region 5, a person merely has to grasp the handle and deflection member 40, push down on the seating area 3 and pull the device of the invention 10 outward and away from the gap region 5 and the piece of furniture 1. If the finger holds 36 are included on the device, these facilitate removal. The frictional protuberances 70 and 72 are not massive enough to prevent a user from removing the device of the invention 10 from the gap region 5 with relative ease, since they function mainly as a deterrent to slight movements in the device of the invention 10 in response to normal everyday usage movements. These frictional protuberances 70 and 72 are assisted past the structural framework of the piece of furniture when the user pushes down on the seating area 3 to insert or remove the device of the invention 10.

Figure 5:
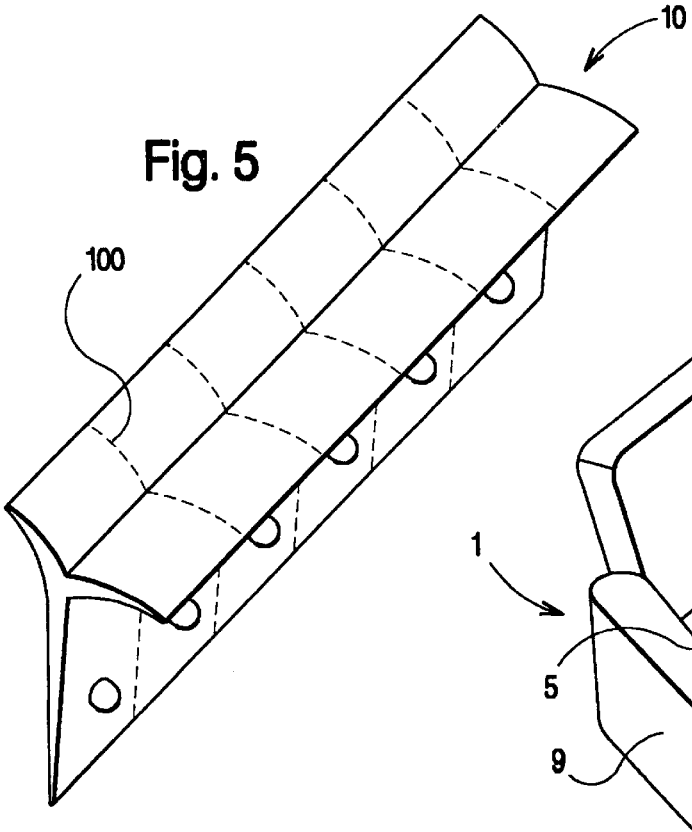
FIG. 5 is an isometric view of the device of the present invention showing a perforated construction for obtaining varying lengths thereof appropriate to the furniture involved.

FIG. 5 is an isometric view of the device of the invention 10 showing perforations 100 located along the device's longitudinal axis. These perforations along the length of the gap blocker of the invention, designed to be easily severed or broken off, allow the length of the device of the present invention 10 to be varied to accommodate gap regions 5 of varying lengths. Obviously, not all articles of upholstered furniture have the same dimensions, and since the insertion of the device of the present invention 10 should be done across the entire gap region 5 of such article of furniture, it becomes necessary to alter the length of the device of the invention 10 to accommodate the length of width of the particular gap region 5. If the device of the invention 10 did not comprise perforations 100, then the length of the device may be shortened with a utility knife or the like.

Figure 6:
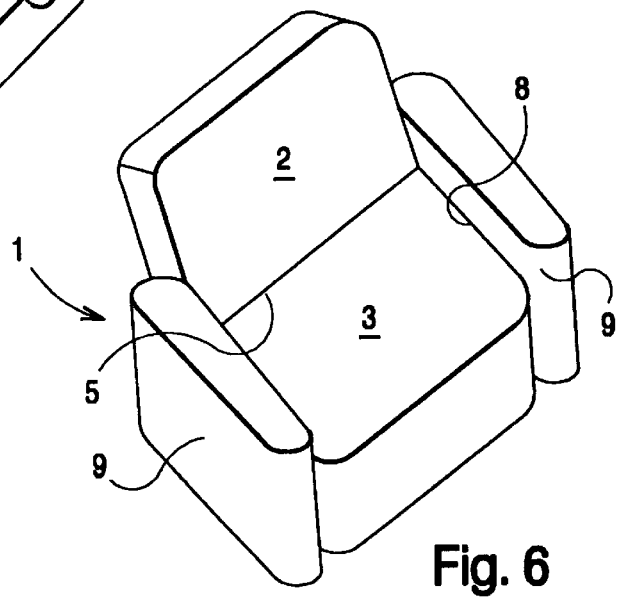
FIG. 6 is an isometric view of an upholstered piece of furniture illustrating or pointing out different placements for the device of the present invention.

FIG. 6 illustrates that the device of the invention 10 may also be used on any side gap regions 8 occurring between the seating region 3 and an arm rest region 9. It will be understood that an arm rest region 9 would have the same general characteristics as the back region 2 previously described in detail, although the plane defining the arm rest region 9 will tend to be substantially more vertical than the plane defining the back region 2 previously described in connection with FIG. 1 and FIG. 4. The side gap region 8 could be as perilous for lost articles or debris as the gap region 5 located along the back of the article of furniture 1 considering many people tend to migrate to a particular end of an elongated piece of furniture for additional arm support, rather than staying somewhere in the middle where there is no arm support. The analysis for a side gap region 8 is identical to that for the previous described gap region 5.

The device of the invention may be made from any suitable material, and although a polymeric composition such as polyethylene, polypropylene or the like is preferred, flexible metal sections or the like could also be used. The shape can be conveniently extruded into form. A relatively soft, flexible material is also beneficial when it becomes necessary to cut or trim the length of the device of the invention to accommodate pieces of furniture of varying sizes.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A debris collecting device for use in a piece of upholstered furniture, the upholstered furniture having a seat cushion support, a backrest adjacent the seat cushion support and side supports on opposite sides of the seat cushion support and at least one seat cushion supported on the seat cushion support comprising:

a. a longitudinally extended member, said member comprised of:

i. a first, slightly flexible, generally wedge shaped lower member, ii. a second, slightly flexible, generally wedge shaped member extending upwardly at an obtuse angle from the first wedge shaped lower member in the direction of, and to be positioned against the backrest or side supports of the piece of furniture, the wedge shaped lower member, iii. a third, slightly flexible, wedge shaped member extending laterally outwardly at an obtuse angle away from the second wedge shaped member and at an acute angle from the first wedge shaped member, b. said first, second and third wedge shaped members being integrally secured to each other at a central location, with a junction formed between the second and third wedge shaped members, in a configuration adapted to block a gap existing between the backrest or side supports and the seat cushion support of the piece of furniture and collect debris at the junction of the second and third wedge shaped members under the at least one seat cushion of said piece of furniture when the first wedge shaped member is inserted into such gap, c. said device additionally comprising rounded, frictional protuberances on at least one side of the first wedge shaped member to releasably maintain the device within the gap, and d. said integrally secured wedge shaped members having perforations along the longitudinal axis of the device to facilitate severing of the device into different lengths.

2. A debris collecting device in accordance with claim 1 additionally comprising finger grasping orifices on the side of the second wedge shaped member opposite the third wedge shaped member.

3. A debris collecting device in accordance with claim 2 wherein the third wedge shaped member is normally slightly downwardly inclined.

4. A debris collecting device in accordance with claim 3 wherein the device is formed from a polymeric material.

5. A debris collection device for placement into a gap region in a piece of upholstered furniture, the upholstered furniture having a seat cushion support, a backrest adjacent the seat cushion support and side supports on opposite sides of the seat cushion support and at least one seat cushion supported on the seat cushion support and the gap region existing between the backrest or side supports and the seat cushion support of the piece of upholstered furniture, comprising:

a. a wedge shaped longitudinal member, b. a lateral supporting member extending outwardly away from the wedge shaped longitudinal member, c. the lateral supporting member separating the wedge shaped longitudinal member into a handle region above the lateral supporting member for grasping by a human hand and an insertion region below the lateral supporting member for insertion into the gap region, the handle region extending generally opposite from the insertion region at an obtuse angle in the direction of and to be positioned against the backrest or side supports of the piece of furniture upon insertion into the gap region of the insertion region, and the lateral supporting member extending outwardly at an obtuse angle away from the handle region of and at an acute angle from the insertion region of the wedge shaped longitudinal member, d. means to frictionally retain the debris collection device in the piece of upholstered furniture, and e. perforations spaced along the debris collection device for separation of the device into an appropriate longitudinal dimension to accommodate the dimensions of the gap region of the piece of upholstered furniture.

6. A debris collection device in accordance with claim 5 wherein the retaining means further comprises generally spherical protuberances located on at least one surface of the insertion region.

7. A debris collection device in accordance with claim 6 wherein the wedge shaped longitudinal member and the lateral supporting member have edges that are rounded to prevent damage to the piece of upholstered furniture.

8. A debris collection device in accordance with claim 7 wherein the lateral supporting member is slightly downwardly curved.

9. A debris collection device in accordance with claim 8 wherein the handle region is slightly outwardly curved.

10. A debris collection device for use in a piece of upholstered furniture, the upholstered furniture having a seat cushion support, a backrest adjacent the seat cushion support and side supports on opposite sides of the seat cushion support and at least one seat cushion supported on the seat cushion support, the debris collection device preventing unwanted debris and fallen articles from passing through a gap existing between the backrest or side supports and the seat cushion support of the piece of furniture and further leading to an interior region of the piece of upholstered furniture comprising:

a. an insertion member for penetrating the gap and extending downwardly therein and maintaining the debris collection device between the backrest or side support and the seat cushion support, b. a handle member extending generally opposite from the insertion member at an obtuse angle in the direction of and to be positioned against the backrest or side supports of the piece of furniture upon insertion but deviated laterally to one side thereof at an obtuse angle, and a lateral supporting member extending outwardly at an obtuse angle away from the handle member and at an acute angle from the insertion member, such handle member and lateral supporting member being integrally connected to the insertion member at the junction thereof, c. a collection surface formed along the junction of the handle member and the lateral supporting member for retaining debris and other fallen articles thereon, d. frictional protuberances positioned only on the insertion member to retain the debris collection device within the gap, e. the handle member and the lateral supporting member being flexible so that the handle member assumes a substantially vertical orientation against the backrest or side support, and the lateral supporting member assumes a substantially horizontal orientation against the seat cushion support, when the insertion member is protrudingly positioned within the gap, and f. means to adjust the dimensions of the debris collection device to accommodate furniture articles of different dimensions.

11. A debris collection device in accordance with claim 10 wherein the means to adjust the dimensions of the device comprise perforations spaced along the longitudinal axis of the device to facilitate severing of the device into different lengths.

12. A debris collection device in accordance with claim 11 further comprising finger grasping orifices positioned within the handle member for grasping of the collection device by the hand of a human user.

13. A gap blocking device for use in a piece of upholstered furniture, the upholstered furniture having a seat cushion support, a backrest adjacent the seat cushion support and side supports on opposite sides of the seat cushion support and at least one seat cushion supported on the seat cushion support, the gap blocking device preventing unwanted debris and fallen articles from passing through a gap existing between the backrest or side supports and the seat cushion support of the piece of furniture, comprising a. a longitudinally extended member, said member comprised of, a first generally wedge shaped member, a second generally wedge shaped member extending at an angle from the first generally wedge shaped member, and a third wedge shaped member extending at an angle from the first and second wedge shaped members, b. said first, second and third wedge shaped members being integrally secured to each other at a central location in a configuration adapted to block the gap when the first generally wedge shaped member is inserted downwardly into the gap under the at least one seat cushion of said piece of upholstered furniture, c. said first, second and third generally wedge shaped members being oriented with respect to each other such that:

i. the second generally wedge shaped member extending oppositely from the first generally wedge shaped member, but deviated laterally to one side thereof at an obtuse angle in the direction of the backrest of side supports upon insertion of the first generally wedge shaped member into the gap, and ii. the third generally shaped member extending oppositely from the first generally wedge shaped member and laterally to the opposite side of the second generally wedge shaped member at an obtuse angle with the second generally wedge shaped member and at an acute angle with the first generally shaped member.

14. A gap blocking device in accordance with claim 13 wherein the first and third wedge shaped members extend farther from the central location than the second wedge shaped member.

15. A gap blocking device in accordance with claim 14 additionally comprising frictional protuberances on at least one side of the first wedge shaped member.

16. A gap blocking device in accordance with claim 15 wherein the integrally secured wedge shaped members have periodic perforations to facilitate severing into different lengths.

17. A gap blocking device in accordance with claim 16 additionally comprising finger grasping orifices on a side of the second generally wedge shaped member opposite the third generally wedge shaped member.

18. A gap blocking device in accordance with claim 13 further comprising means to adjust the dimensions of the device to accommodate gaps of different dimensions.

19. A gap blocking device in accordance with claim 13 further comprising means to frictionally retain the gap blocking device in the gaps of pieces of upholstered furniture.

20. A gap blocking device in accordance with claim 19 further comprising means to adjust the dimensions of the device to accommodate gaps of different dimensions.

* * * * *